US007131355B2

(12) United States Patent
Williams

(10) Patent No.: US 7,131,355 B2
(45) Date of Patent: Nov. 7, 2006

(54) LIGHTWEIGHT WRENCH

(76) Inventor: Steven Andrew Williams, 1995 Ferndale Pl., Thousand Oaks, CA (US) 91360

( * ) Notice: Subject to any disclaimer, the term of this patent is extended or adjusted under 35 U.S.C. 154(b) by 0 days.

(21) Appl. No.: 10/992,527

(22) Filed: Nov. 19, 2004

(65) Prior Publication Data

US 2005/0115367 A1 Jun. 2, 2005

Related U.S. Application Data

(60) Provisional application No. 60/526,089, filed on Dec. 2, 2003.

(51) Int. Cl.
*B25B 13/12* (2006.01)
*B25B 13/34* (2006.01)
*B25B 13/22* (2006.01)

(52) U.S. Cl. ..... 81/151; 81/145; 81/129

(58) Field of Classification Search ..... 81/151, 81/103, 145, 148, 130, 357, 129, 177.2
See application file for complete search history.

(56) References Cited

U.S. PATENT DOCUMENTS 1,627,035 A * 5/1927 Jahn ..... 81/99
2,057,899 A * 10/1936 Lucas ..... 81/99
2,713,803 A * 7/1955 Schwaiger ..... 81/383
2,718,166 A * 9/1955 Hollenbeck ..... 81/65
2,742,809 A * 4/1956 Brynge et al. ..... 81/101
3,280,667 A * 10/1966 Woodling ..... 81/101
3,964,115 A * 6/1976 Platek ..... 7/152
3,996,820 A * 12/1976 Tuell ..... 81/145
4,144,779 A * 3/1979 Honick ..... 81/103
D271,274 S * 11/1983 Tasato ..... D8/23
6,182,540 B1 * 2/2001 Wang ..... 81/177.4
6,349,621 B1 * 2/2002 Khachatoorain ..... 81/99
6,959,952 B1 * 11/2005 Williams ..... 294/86.4

* cited by examiner

*Primary Examiner*—Lee D. Wilson
*Assistant Examiner*—Alvin J Grant
(74) *Attorney, Agent, or Firm*—Christie, Parker & Hale, LLP

(57) ABSTRACT

A lightweight, adjustable wrench comprising of a moveable jaw with a reach that is shortened or lengthened with a strap or a cable. The loose end of the strap or cable is secured to the wrench's shank by a cam lock, or similar locking device. Since the strap or cable is the means for the wrench's jaws adjustment, a quicker and easier fit to the pipe or object to be gripped can be obtained. The wrench is more convenient to adjust, since the means for adjustment are located near the handle of the wrench as opposed to the shank end of present designs. The strap or cable adjustment also allows the wrench's shank and handle to be designed hollow and a larger diameter to reduce weight. The wrench can be made in any proportion for any sized application.

15 Claims, 5 Drawing Sheets

LIGHTWEIGHT WRENCH

CROSS REFERENCE TO RELATED APPLICATIONS

This application is based on and claims priority to Provisional Patent Application No. 60/526,089, entitled "Lightweight Wrench", filed on Dec. 2, 2003.

BACKGROUND

This invention relates to the field of devices for gripping pipes, nuts, or the like, and more particularly to a wrench using a strap or a cable as the means to adjust the jaws of the wrench as opposed to a conventional barrel adjusting nut. The purpose of the invention is to lighten the weight of the wrench, reducing the amount of unnecessary metal or material needed to create a strong wrench, thusly reducing production and shipping costs of the invented wrench. A lighter wrench will offer the user greater mobility and result in reduced muscle fatigue.

BRIEF SUMMARY

The invention is an improvement over the standard pipe wrench using a barrel nut adjuster, by creating a lighter and easier method to adjust wrench's jaw using a strap, cable or similar method. The invention's moveable/adjustable jaw's reach is shortened or lengthened with a strap or a cable, which acts as a tension element attached to its end and the loose end of the strap or cable is then secured to the wrench's shank by means of an adjustable locking device, such as a cam lock or similar locking device. Since the tension element is the adjustment mechanism, a quicker and easier fit to the pipe or the object to be gripped can be obtained. The size of the wrench can be made in any proportion for any job application. The tension element can be made from, but not limited to, woven nylon, Kevlar, woven steel, or a braided steel cable.

The strap type adjustment also allows the wrench's shank and handle to be of a hollow design and a larger diameter (e.g., tubular structures). Both of these attributes reduce the overall weight of the wrench, creating numerous benefits. The first of which is that the invented wrench generates less fatigue for the user. A standard pipe wrench, due to its weight, can be very fatiguing especially if used in awkward positions, such as under a kitchen sink. A second benefit of the invented lighter wrench makes the wrench more buoyant for underwater use (the hollow, e.g., a tubular handle can be filled with a buoyant material) or a lighter payload for spacecraft use and other environments where saving weight is crucial. A third benefit is a lower production cost because of the reduced metal used to make the wrench. A fourth benefit is a lighter product means reduced shipping costs for the manufacturer. Another benefit is that the provision of a hollow, larger diameter handle can be designed to be more ergonomic, allowing the user to grip the handle and apply more force to the wrench comfortably.

DETAILED DESCRIPTION

Figure 1:
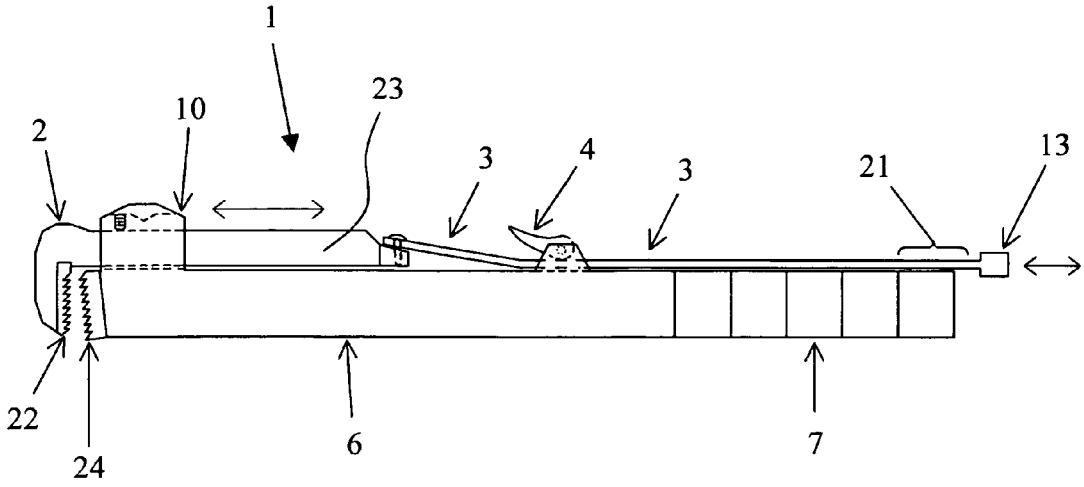
FIG. 1 is an elevated view of the wrench with an adjusting strap.

FIG. 1 shows an exemplary embodiment of the lightweight adjustable wrench 1 of the invention, and some possible proportions thereof. An adjustment tension element 3 is used to adjust the reach of an adjustable jaw portion 2 and thereof extends over a handle 7, allowing the user access to grasp the tension element 3, which as shown takes the form of a strap. The strap 3 is preferably formed of a material that has very little stretch in it, such as high tensile steel strap, low stretch nylon strap, woven cloth, steel cable, and other materials. A grip 13 is preferably attached near the working end 21 of the strap 3 for the user to grasp easily. A cam lock 4 is used to adjust a working length of the strap 3, and can be located on a shank portion 6 rearwardly of the shaft portion 23. The adjustable jaw portion 2 has jaw teeth 22 at a front thereof and a shaft portion 23 extending rearwardly. A shank portion 6 is provided with a jaw portion engagement, such as a retention tunnel 10 through which the shaft portion 23 of the adjustable jaw portion 2 slidably passes there through. The jaw portion engagement can be provided in other forms if desired. The shank portion 6 has fixed teeth 24 mounted at a front end thereof. The shank portion 6 can be formed together with a handle 7, or the handle be separately attached thereto.

Figure 2:
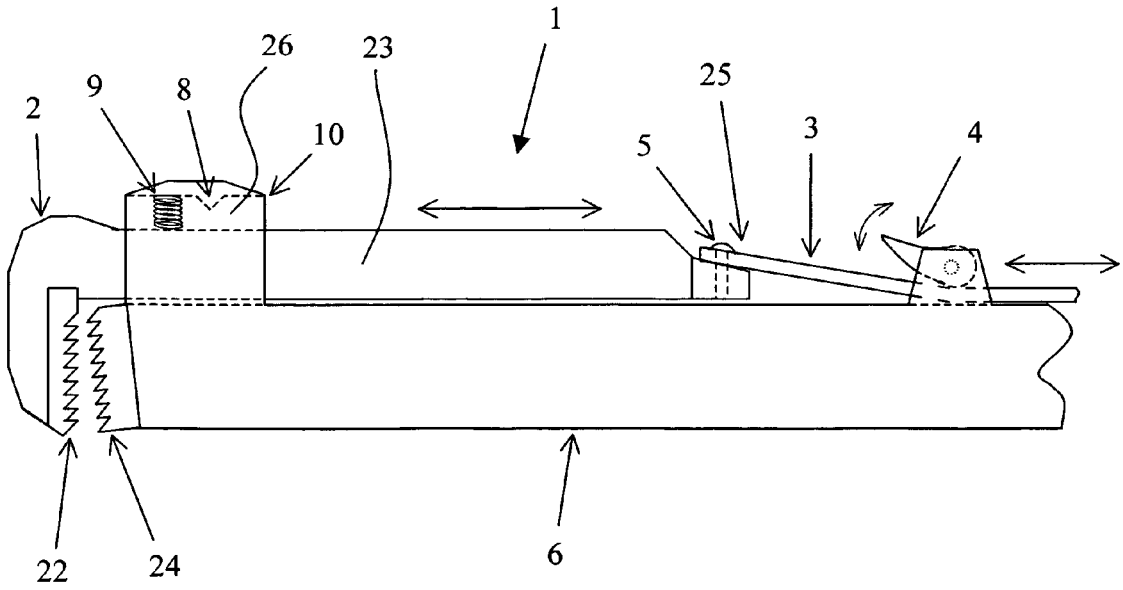
FIG. 2 is an enlarged, elevated view of the wrench of FIG. 1.

FIG. 2 shows an expanded view of the wrench 1 and its adjustable jaw portion 2. The user can shorten or lengthen the reach of the adjustable jaw portion 2 by changing the effective working length of the strap 3, which acts to move the movable jaw teeth 22 and fixed jaw teeth 24 closer and further apart from each other as is required to grasp on the object. The strap 3 is attached to the adjustable jaw 2 at a fixed end 25, e.g., with rivets 5, screws, crimping of metal, a sewn loop, or other known methods of attachment. The opposite, free end 21 of the strap 3 is loose and free for the user to grasp the grip 13 to adjust the working length of the strap. As shown in FIG. 1, a grip 13 is, for example, an ergonomic bulb which is optionally provided at the free end 21 at the strap to aid the user in pulling the strap 3. Turning back to FIG. 2, the user adjusts the working length of the strap 3 according to the size of the object to be gripped (not shown) with the wrench 1. The desired working strap's 3 length is maintained with the cam lock 4 or similar locking mechanism located on the handle 7 or shank 6 rearwardly of the adjustable jaw portion 2. The shaft portion 23 of the adjustable jaw portion 2 passes through a passageway 26 in the jaw retention tunnel 10, which said passageway 26 is slightly oversized to allow the wrench's shaft 23 to pivot and slide about point 8, which is near the upper center of the passageway 26 of jaw retention tunnel 10. This pivoting and sliding of the shaft portion 23 allows the wrench 1 to decrease the distance between the jaw teeth 22 of the adjustable jaw portion 2 and the fixed jaw teeth 24 of the shank portion 6 during use and thusly increase the grip on a pipe or other objects. The jaw teeth 22 and 24 can be separate units affixed to the adjustable jaw portion 2 and shank portion 6, respectively, by rivets, screws, etc. To facilitate the pivoting of the wrench's 1 shaft 23 and open the jaws 22 and 24, a spring 9 can be provided in the passageway 26. The spring's 9 downward force on the shank 6 enables the wrench 1 to produce some ratcheting qualities during its use. The spring 9 also counteracts the downward force acted upon the adjustable jaw portion 2 by the strap's 3 tension. To facilitate pivoting and closing of the jaws 22 and 24, the user pushes down on the handle 7 while operating the wrench 1.

Figure 3:
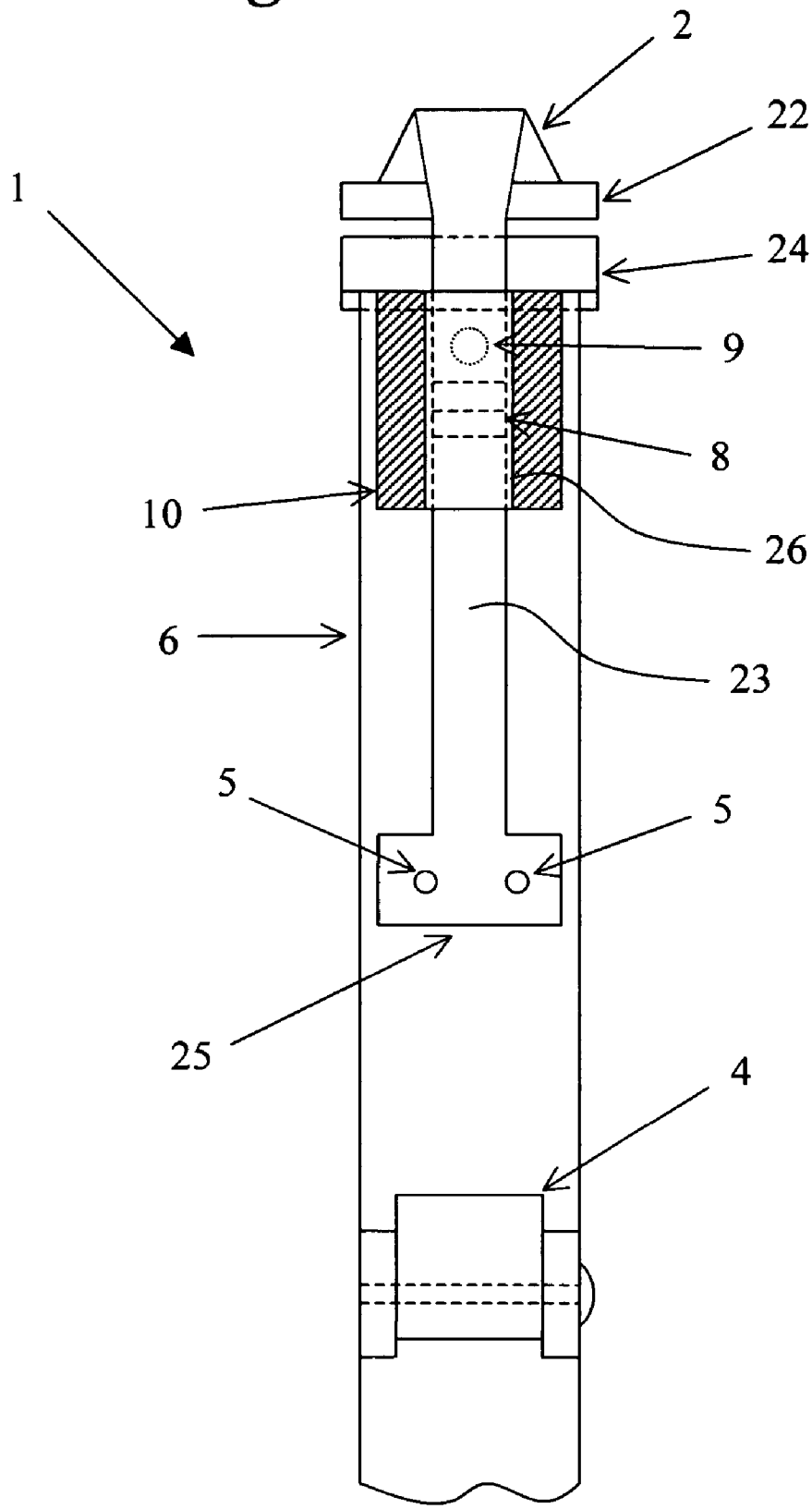
FIG. 3 is a top view of the adjustable jaw and cam lock of the wrench of FIG. 1, but without showing the adjusting strap or cable.

FIG. 3 shows a top view of the wrench 1 of FIG. 2 with the strap 3 omitted for clarity.

Figure 4:
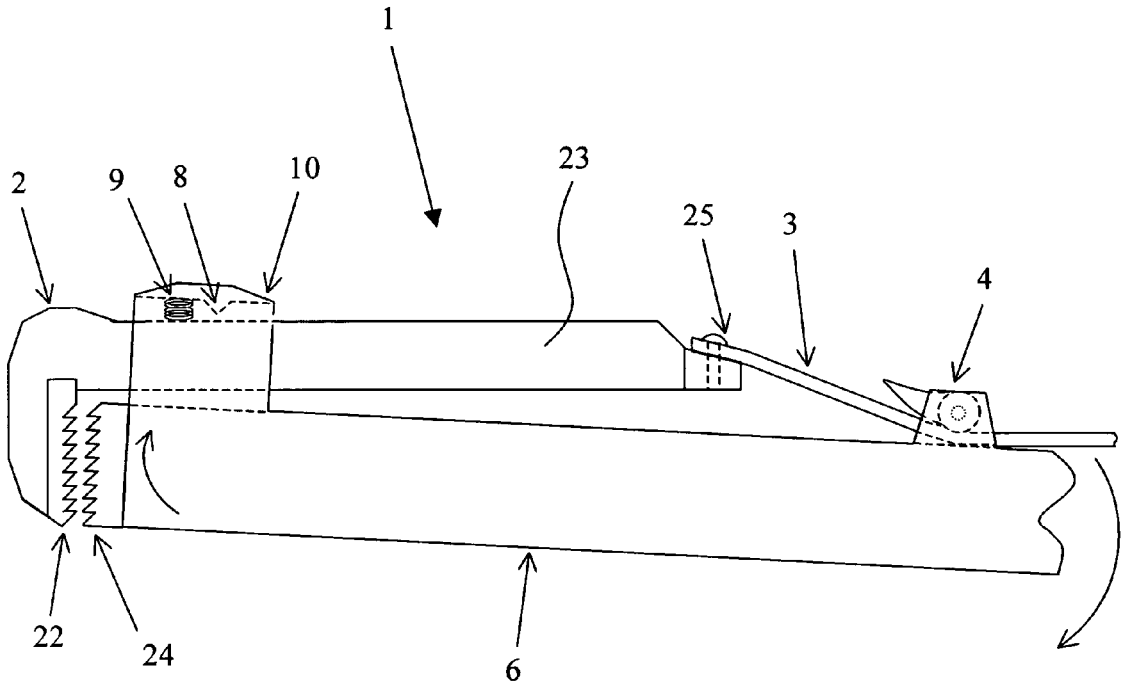
FIG. 4 is an elevated view of the wrench of FIG. 1 with the jaws and adjusting strap in a gripping position.

FIG. 4 shows the wrench 1 in a position such as if it were being used. The pivoting of the shank 6 in respect to the slide able shaft's 23 position allows the jaws 22 and 24 to move closer somewhat, as the difference can be seen by turning back to FIG. 2. As the shank 6 is rotated around the pivot point 8, the jaw 24 moves upward and toward the front of the shaft 23 carrying the teeth 22. As the pivoting occurs, the strap 3 is pulled tighter (the cam lock 4 travels away from the strap's 3 fixed end 25), therefore the effective length of the strap 3 is decreased, which further decreases the distance between the jaws 22 and 24 and increases the wrench's 1 grip. This cantilevering action is very important to the effectiveness of the wrench 1.

Figure 5:
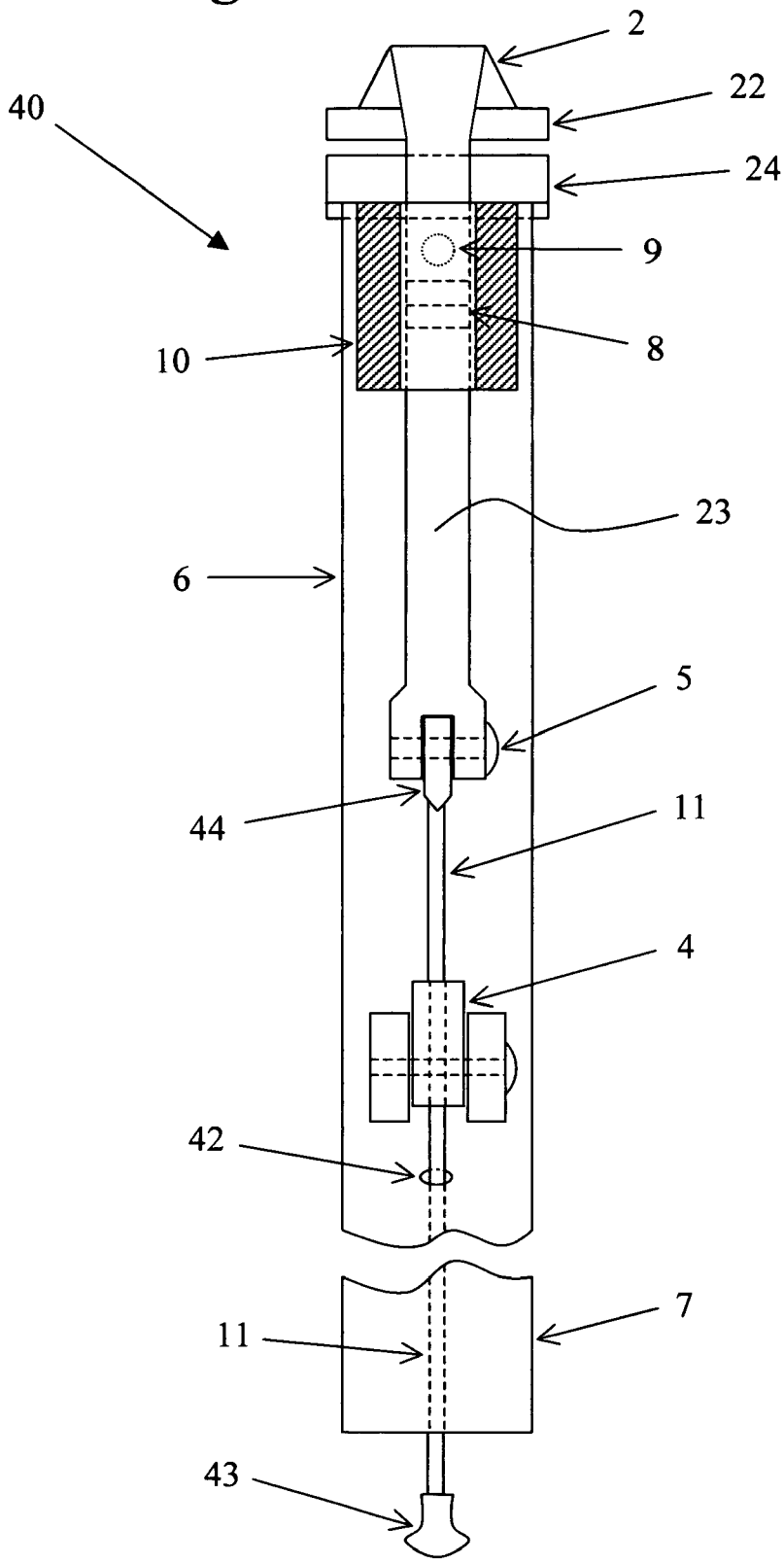
FIG. 5 is a top view of a wrench of FIG. 4.

FIG. 5 shows a second exemplary embodiment of the wrench of the invention 40 utilizing a braided steel cable 11 as the tension element for the user to lengthen or shorten the reach of the adjustable jaw portion 2. The same references numerals are used to describes parts and features that are the same or similar. The cable 11 is secured to the end of the adjustable jaw portion 23 with a rivet 5 or similar means of attachment and a cable eyelet 44 or loop. The cable 11 is movably secured to the shank 6 in the same manner as the first embodiment of the device, e.g., with a cam lock 4 type device. The cable 11 is optionally routed into the shank 6 and through the inside of the handle 7, entering the shank 6 at a hole 42. Routing the cable 11 through the handle 7 allows the user's grip to be unobstructed by the cable 11. The end of the cable 11 that the user grasps to adjust the reach of the adjustable jaw 2 is preferably fitted with a grip, such as an ergonomic bulb 43.

Figure 6:
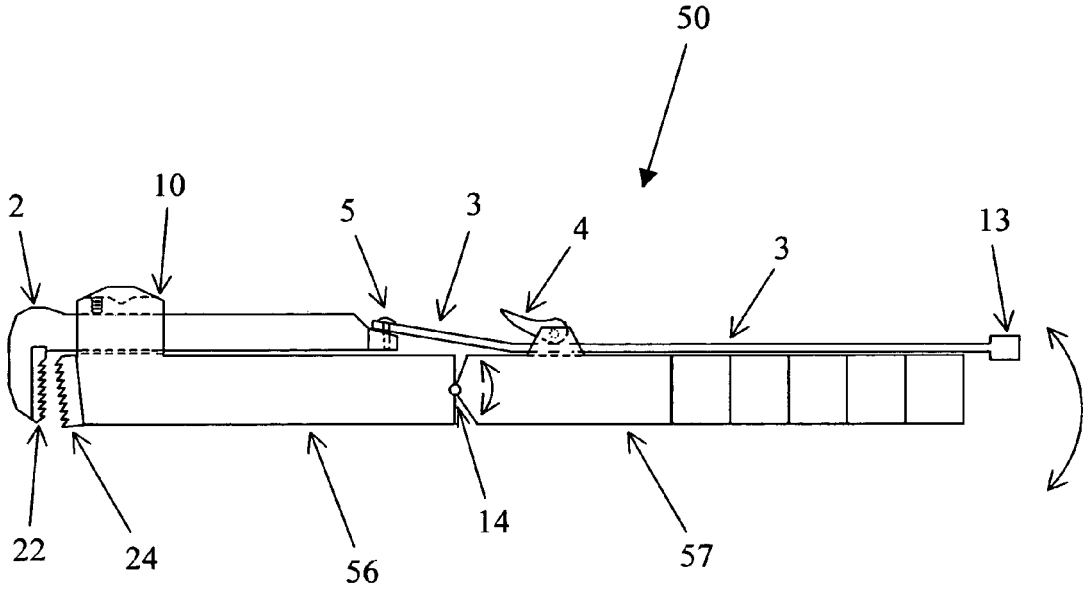
FIG. 6 is an elevated view of another embodiment of a wrench of the invention having a hinged handle.

FIG. 6 shows a third version of the wrench 50 utilizing a hinged 14 shank 56 of the wrench 50. In this embodiment, a hinge 14 is used to connect together the shank portion 56 and the handle portion 57, and a cam lock device 4 is fixed on the handle portion 57. The hinging of the shank 56 to the handle 57 allows for the handle 57 to be pivoted on its hinge 14 so as to essentially tighten the strap 3 as the wrench 50 is being used. When the user pulls the grip 13 on the tension element 3 to adjust the wrench 50, the handle 57 will pivot upwardly, providing for a shorter strap 3 length than if the shank 56 and handle 57 were rigidly attached to each other, creating a preload of sorts.

When using the wrench 50, the tension element 3 is effectively tightened as the user pulls the handle 57 downwardly in relation to the shank's 56 stationary position. This action causes the jaws 22 and 24 to move closer to each other and provide more gripping force as the wrench 50 is turned to tighten or loosen a pipe or some other object.

The drawings in the foregoing description are not intended to represent the only form of the invention in regard to the details of its construction and manner of operation. In fact, it will be evident to one skilled in the art that modifications and variations can be made without departing from the spirit and scope of the invention. Although specific terms have been employed, they are intended in a generic and descriptive sense only and not for purposes of limitation.

I, claim:

1. A lightweight wrench adapted for gripping variously sized objects, the wrench comprising:

a movable shaft;

an adjustable jaw portion having a jaw at a proximal end of said shaft;

a shank portion having a fixed jaw at a proximal end of the shaft and a handle portion at the distal end thereof; said shank portion having an engagement means for movably retaining the movable shaft;

a tension element having a first end and a second end; wherein said first end is fixed to the movable shaft at a distal end thereof; said tension element being slidably engaged to said shank portion to adjust a working distance between said adjustable jaw and said fixed jaw; and wherein the engagement means on the shank portion comprises a tunnel through which the shaft of the adjustable jaw portion slidably and pivotally passes.

2. The lightweight wrench of claim 1, wherein the tension element comprises one of a strap and a cable.

3. The lightweight wrench of claim 1, wherein the tunnel further comprises a pivot about which the adjustable jaw portion is pivotal.

4. The lightweight wrench of claim 3, wherein the tunnel further comprises a bias spring for biasing the adjustable jaw portion such that said adjustable jaw is closer to the fixed jaw.

5. The lightweight wrench of claim 1, wherein said second end of said one of said strap and said cable is adjustably engaged to the shank portion by an adjustable lock device.

6. The lightweight wrench of claim 5, wherein the adjustable lock device is a cam lock.

7. The lightweight wrench of claim 1, wherein the handle portion is integral with the shank portion.

8. The lightweight wrench of claim 1, wherein the handle and shank comprise tubular structures.

9. The lightweight wrench of claim 1, wherein the jaw of the adjustable jaw portion and the fixed jaw comprise gripping teeth.

10. A lightweight wrench adapted for gripping variously sized objects, the wrench comprising:

a movable shaft;

an adjustable jaw portion having a jaw at a proximal end of said shaft;

a shank portion having a fixed jaw at a proximal end of the shaft and a handle portion at a distal end thereof; said shank portion having an engagement means for movably retaining the movable shaft;

an adjustable locking device;

a tension element having a first end and a second end; wherein said first end is fixed to the movable shaft at the distal end thereof; and wherein said second end is a free end that is adjustably lockable by said adjustable locking device to secure a fixed length of the tension element and adjust the working distance between the jaw and the fixed jaw; and wherein the engagement means of the shank comprises a tunnel through which the shaft of the adjustable jaw portion slidably and pivotally passes.

11. The lightweight wrench of claim 10, wherein the tension element comprises one of a strap and a cable.

12. The lightweight wrench of claim 10, wherein the tunnel further comprises a pivot about which the adjustable jaw portion is pivotable, and a bias spring for biasing the adjustable jaw.

13. The lightweight wrench of claim 10, wherein the handle portion is hingedly attached to the shank portion, and the adjustable lock device is attached to the handle.

14. The lightweight wrench of claim 10, wherein the handle and the shank comprise tubular structures.

15. The lightweight wrench of claim 10, wherein the jaw of the adjustable portion and the fixed jaw comprise fixed teeth.

* * * * *